US005787659A

United States Patent [19]

Rinehart

[11] Patent Number: 5,787,659

[45] Date of Patent: Aug. 4, 1998

[54] WEEP VALVE FOR FRAME MEMBER

[75] Inventor: David M. Rinehart, Alpharetta, Ga.

[73] Assignee: Kawneer Company, Norcross, Ga.

[21] Appl. No.: 771,165

[22] Filed: Dec. 20, 1996

[51] Int. Cl.[6] ..... E06B 7/14

[52] U.S. Cl. ..... 52/209; 52/302.1; 52/204.52

[58] Field of Search ..... 52/209, 302.1, 52/302.3, 105, 235, 204.52

[56] References Cited

U.S. PATENT DOCUMENTS

| | | | |
|---|---|---|---|
| 3,503,169 | 3/1970 | Johnson et al. | 52/209 |
| 4,003,171 | 1/1977 | Mitchell | 52/209 |
| 4,608,796 | 9/1986 | Shea, Jr. | 52/209 X |
| 4,619,097 | 10/1986 | Trummer et al. | 52/733.4 X |
| 4,644,717 | 2/1987 | Biebuyck . | |
| 4,715,152 | 12/1987 | Tanikawa | 52/209 |
| 4,819,405 | 4/1989 | Jackson | 52/209 X |
| 4,852,312 | 8/1989 | Harbom | 52/209 X |
| 4,984,402 | 1/1991 | Davies | 52/209 X |
| 5,123,212 | 6/1992 | Dallaire et al. | 52/209 |
| 5,323,577 | 6/1994 | Whitmyer | 52/209 X |

*Primary Examiner*—Creighton Smith
*Attorney, Agent, or Firm*—Jones & Askew, LLP

[57] ABSTRACT

A drainage system is disclosed for building framing systems comprising weep holes for draining water from an interior cavity to the exterior of the buildilng. The drainage system comprises a weep valve overlying a weep hole in a frame member which provides a passage for infiltrated water from a glass pocket to the exterior of the building while at the same time preventing air infiltration. The weep valve includes a membrane of an elastomeric or other suitable material having a slit formed therein which permits water to seep out. The slit seals sufficiently tightly that, when the framing system is under windload, airflow back through the weep hole is substantially eliminated. Since water infiltration is a result of air infiltration, water infiltration is thus also substantially eliminated.

15 Claims, 2 Drawing Sheets

WEEP VALVE FOR FRAME MEMBER

TECHNICAL FIELD

The present invention relates generally to building frame members, and relates more specifically to a drainage system for windows, framing, curtainwalls, storefronts, and skylights.

BACKGROUND OF THE INVENTION

Window systems, building frame systems, curtainwalls, storefronts, and skylights are often required to provide performance levels of air and water infiltration that can be difficult to meet. Many systems are designed with fabricated components that are assembled to form a window, wall, or framing system. As a rule, long term deterioration of such building components is prevented by specified industry practices which control infiltrating water to the exterior of a framing system through passages known as "weep holes." For instance, when using insulated glass as the glazing infill, the edge seal between the interior and exterior glass lites must be kept dry or deterioration of the edge seal may occur, compromising the thermal performance of the glass lite. Another example of deterioration that can occur is when sealant is exposed to water for long periods of time, which can adversely affect the adhesion to a substrate.

While weep holes are necessary, they are problematic with respect to permitting air infiltration into the window system. This resultant air infiltration can enable water infiltration to occur when the pressure differential between the exterior and the interior of the window is sufficient to draw water into the window system. To prevent this from occurring, two common industry approaches are employed, the "rain screen" and "pressure equalization" principles. Protecting the opening of the weep hole from direct exposure to the elements, including water in the form of rain, is commonly known as the "rain screen" principle. Although the rain screen principle is frequently used, the pressure differential between the interior and the exterior of the window system can be such that water is drawn into the window system prior to equalization between the different pressure areas. This is known as "pressure equalization".

To counteract this water infiltration, many design solutions may be incorporated into the design and/or assembly of the framing system, including but not limited to installing open celled weep baffles, applying a sealant heel bead between the infill and the window framing member, sealing the ends of the internal glass stops, or designing the system such that an interior water barrier is high enough for controlled water infiltration prior to pressure equalization being achieved. The first three design solutions are based on the principle of controlling air infiltration, thus preventing water infiltration. However, these solutions can be labor- or material-intensive and require a certain amount of skill to apply. Further, weep baffles can deteriorate or clog over time. The fourth design solution does nothing to control air infiltration but merely provides an inner barrier of sufficient height which prevents water from infiltrating the framing system before pressure equalization can occur. Because its water infiltration resistance is determined by the height of the inner barrier, this approach may not be an option because of aesthetic and other design considerations.

Thus a need exists for a device for window systems that controls air infiltration through the weep holes, yet allows water to pass to the exterior from the internal cavities, protecting the building components from deterioration.

There is a further need for a device for window systems that controls air infiltration through the weep holes which is not labor- or material-intensive, does not require skilled workers to install, and which will resist deterioration.

There is another need for a device for window systems that controls water infiltration through the weep holes from the exterior to the interior of the framing system without requiring an excessively tall frame member profile, which can be aesthetically displeasing and may present other design problems.

One possible solution is proposed in U.S. Pat. No. 4,644,717, which discloses a one-way valve for weep holes in the horizontal mullions of a curtain wall system. The weep hole is located on a vertical face of the frame member. A flap member overlies the weep hole on the exterior surface of the frame member, and a portion of the flap which is above the weep hole is adhered to the frame member. Thus the portions of the flap overlying and beneath the weep hole are free to deform outward in response to the pressure of water within the frame member. The outward deformation of the flap permits water to flow through the weep hole, between the interior surface of the flap and the exterior surface of the frame member, and out past the lower edge of the flap. However, positive wind loads on the exterior of the frame member force the flap against the exterior surface of the frame member to form a seal over the weep hole, thereby preventing air and water from infiltrating back through the weep hole.

The one-way valve for weep holes disclosed in the aforementioned U.S. Pat. No. 4,644,717 is limited to applications wherein the weep hole is located on a vertical face of the frame member and will not work where the weep hole is located on a horizontal face of the frame member because the unadhered end of the flap would tend to sag, permitting air and water infiltration.

Thus there is a need for a device for drainage of a framing system which does not limit the location of the weep holes to a vertical face of the frame member.

SUMMARY OF THE INVENTION

Stated generally, the present invention comprises a device for a drainage of framing systems which provides a passage for infiltrated water from the interior to the exterior of the building while at the same time preventing air infiltration. The drainage system is not labor- or material-intensive, does not require special skills to install, and exhibits superior resistance to deterioration. Further, the drainage system of the present invention does not limit the weep holes to any particular location.

Stated somewhat more specifically, the present invention comprises a weep valve comprising an elastomeric cover installed over each weep hole. The weep valve has one or more slits formed through it in a position which overlies the weep hole. The weep valve permits water to seep through the slits, while at the same time resisting airflow back through the weep hole. Thus water infiltration is substantially eliminated. The weep valve functions regardless of its orientation on the framing system.

Thus it is an object of the present invention to provide an improved drainage system for windows, framing, curtainwalls, and skylights.

It is another object of the present invention to provide a device for drainage of a framing system that controls air infiltration through the weep holes, yet allows water to pass to the exterior from the internal cavities, protecting the building components from deterioration.

Still another object of the present invention is to provide a device for drainage of a framing system that controls air infiltration through the weep holes which is not labor- or material-intensive, does not require skilled workers to install, and which will resist deterioration.

Yet another object of the present invention is to provide a device for drainage of a framing system that controls water infiltration back through the weep holes to the interior of the window system without requiring an excessively tall interior water barrier, which can be aesthetically displeasing and may present other design problems.

It is still a further object of the present invention to provide a device for drainage of a framing system which does not limit the location of the weep holes to a vertical face of the frame member.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
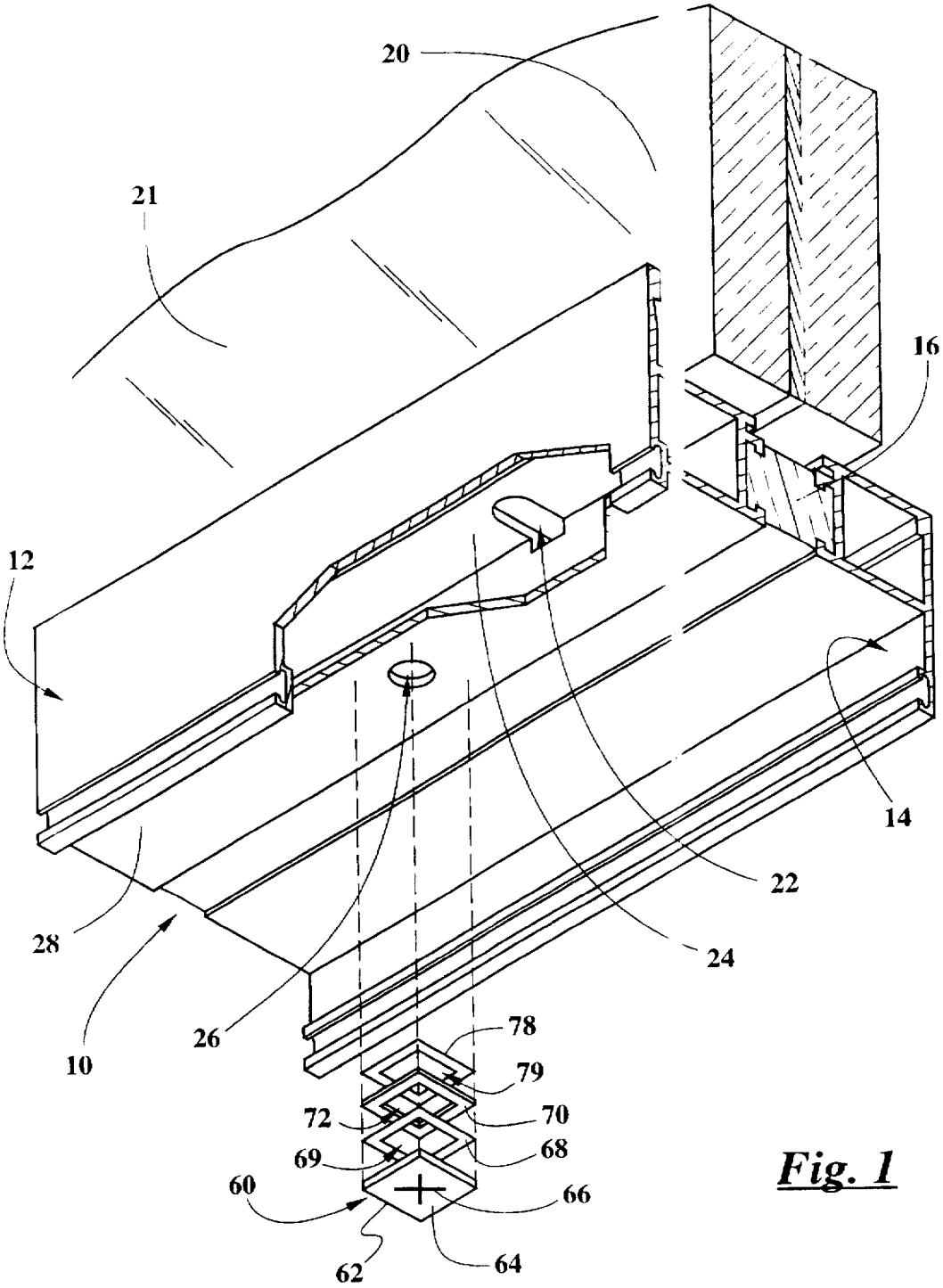
FIG. 1 is an isometric view of a window frame member with an improved weep valve according to the present invention, with a section of the frame member removed to reveal interior detail.

Referring now to the drawings, in which like numerals indicate like elements throughout the several views, a frame member 10 of a project-in vent window is shown. The frame member 10 consists of an outer hollow extrusion 12 and an inner hollow extrusion 14 structurally interconnected by a thermally insulating connector 16. The frame member 10 is manufactured by a process known as the "pour-debridge" process, in which the outer and inner hollow extrusions 12, 14 are initially formed as a unitary structure connected by a "bridge." A liquid thermally insulating material is poured into a pocket defined in the unitary structure, the thermally insulating material is cured to form a solid, connector 16, and the bridge is then removed to thermally isolate the outer and inner hollow extrusions 12, 14. This procedure is disclosed in more detail in U.S. Pat. No. 4,619,097 to Trummer et al., which patent is incorporated herein by reference.

An interior cavity such as a glass pocket 20 is formed on the upper surface of the frame member 10 and accepts the lower edge of an infill panel such as a glass lite 21. A weep slot 22 is formed through the upper wall 24 of the outer hollow extrusion 12. A weep hole 26 is formed in the lower wall 28 of the outer hollow extrusion 12.

A weep valve 60 consists of a membrane 62 having an outer face 64 and an inner face (not visible in the drawing, but comprising the membrane face opposite the outer face 64). The membrane 62 is comprised of rubber or other suitable material which is sufficiently soft to allow for flexibility and yet sufficiently stiff to prevent sagging within the part. In the disclosed embodiment the membrane 62 is 0.625" square, 0.062" thick, and is comprised of a very firm Poron foam, a cellular urethane manufactured by Rodgers Corporation, East Woodstock, Conn., under the product designation 4701-12-30062-1604. Another suitable material is neoprene, preferably having a hardness of 65±5 on the Shore A hardness scale.

A pair of slits 66 which extend through the membrane 62 and which intersect generally in the shape of an "X" are located in the center of the membrane 62.

The lower face of a first piece of double-sided tape 68 is adhered to the back face of the membrane 62. The double-sided tape 68 of the disclosed embodiment is 3M's 9690, a high strength acrylic pressure sensitive adhesive. The double-sided tape 68 is cut to an overall size equal to that of the membrane 62. The double-sided tape 68 has a square central opening 69 greater in dimension than the size of the weep hole 26 in the frame member 10. The square central opening 69 is also greater in dimension than the slits 66 in the membrane 62 and overlies the slits.

The lower surface of a spacer 70 is adhered to the upper surface of the first piece of double-sided tape 68. In the disclosed embodiment, the spacer 70 is 0.045" thick and is sized and shaped to conform to the membrane 62. In the disclosed embodiment the spacer 70 is comprised of a soft Poron foam manufactured by Rodgers Corporation under the product designation 4701-01-20062-1604. However, the spacer can be comprised of many other materials which are more or less elastomeric than the membrane 62 and which are harder or softer than the membrane.

The spacer 70 has a central cut-out 72 aligned with and corresponding in size and shape to the square central opening 69 in the first piece of double-sided tape 68.

A second piece of double-sided tape 78, identical in size, shape, and composition to the first piece of double-sided tape 68, has a square central opening 79. The second double-sided tape 78 is adhered to the upper side of the spacer 70. The opposite face of the second piece of double-sided tape 78 is adhered to the lower wall 28 of the outer hollow extrusion 12.

The square central opening 69 in the first tape 68, the central cut-out 72 in the spacer 70, and the square central opening 79 in the second tape 78 cooperate to provide an opening which overlies the weep hole 22. Water which exits the weep hole 22 passes through the openings 69, 72, and 79 to reach the slits 66 in the membrane 62.

In use, any water which collects in the glass pocket 20 will drain through the weep slot 22 into the outer hollow section 12 of the frame member 10. The water then enters the weep hole 26 and seeps through the X-shaped slits 66 in the membrane 62 to the exterior of the building. However, the X-shaped slits 66 normally seal sufficiently tightly against airflow that air infiltration from the exterior of the building through the weep hole 26 will be minimized, if not virtually eliminated. Since water infiltration from the outside of the building is directly proportional to the airflow through the weep hole 26, it follows that water infiltration from outside the building to the interior of the building through the weep hole will also be substantially eliminated. Thus the weep valve 60 permits water to drain from the glass pocket 20 while at the same time preventing air and water infiltration from outside the building into the interior of the glass pocket.

Figure 2:
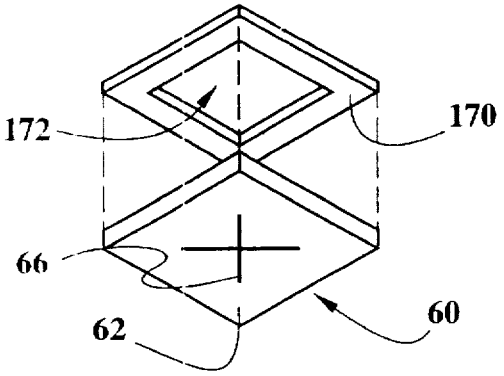
FIG. 2 is an isometric view of a first alternate embodiment of a weep valve according to the present invention.

As an alternative to the four-piece construction of the weep valve 60 described above, a filler 170 can be comprised of a relatively thick piece of double-sided tape, as shown in FIG. 2. One side of the filler 170 is adhered to the interior surface of the membrane 62, and the opposite side of the filler is adhered to the lower wall 28 (see FIG. 1) of the outer hollow extrusion 12. By constructing the filler from double-sided tape, the need for two separate pieces of double-sided tape 68, 78 is eliminated. A suitable relatively thick double-sided tape is 3-M's 4950 VHB acrylic tape, 0.045" thick, with a paper release liner. Preferably a central portion of the filler 170 which overlies the X-shaped slit 66 in the membrane 62 and the weep hole 26 is removed to form an opening 172 which clears the inner surface of the membrane over the X-shaped slit. Optionally a filler without a central opening can be applied to the membrane 62 prior to the slit 66 being formed in the membrane, such that the slit 66 extends through both the membrane and the double-sided tape.

Figure 3:
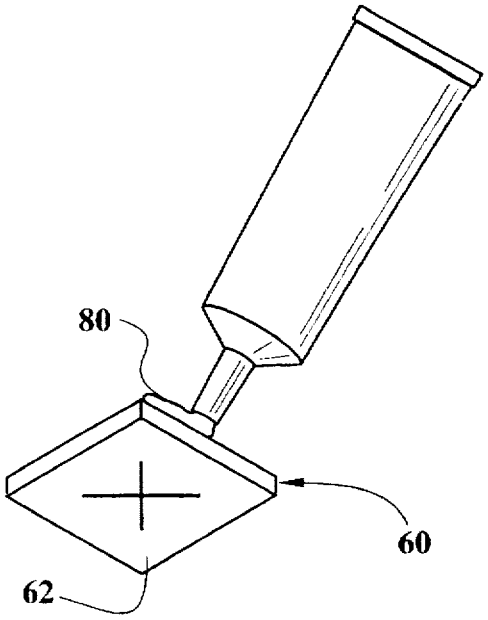
FIG. 3 is an isometric view of a second alternate embodiment of a weep valve according to the present invention.

As yet another alternative, in place of the two pieces of double-sided tape 68, 78, a conventional adhesive 80 can be applied around the marginal portion of the inner face of the membrane 62, as shown in FIG. 3, to adhere the weep valve 60 to the frame member, with or without a spacer 70.

The weep valve 60 of the present invention provides numerous advantages over prior art drainage systems. First, the weep valve 60 is inexpensive to manufacture and easy to apply by even unskilled labor. Second, the weep valve 60 of the present invention provides suitable drainage and prevents water infiltration independent of the configuration of the frame member; a frame member having a tall inner barrier is not necessary to the operation of the weep valve. Third, the weep valve 60 is not limited to any particular orientation and can be installed over weep holes in either horizontal or vertical walls of a frame member.

In addition, whereas the weep valve in the aforementioned U.S. Pat. No. 4,644,717 is adhered to the frame member only along its upper edge, the weep valve 60 of the disclosed embodiment is adhered to the frame member 10 around its entire periphery. As a result, the weep valve 60 of the disclosed embodiment is less likely to, separate from the frame member.

While the foregoing embodiment has been disclosed with respect to a window framing system, it will be understood that the drainage system of the present invention is also useful in curtainwall and storefront framing systems, skylights, and any other building framing system in which weep holes are conventionally used. Also, while the foregoing embodiment has been disclosed with respect to a spacer 70, it will be understood that the spacer is optional and can be omitted from the installation and still achieve acceptable results.

Further, while the infill panel of the disclosed embodiment consists of a glass lite 21, it will be understood that the invention, is not limited to glass infill panels and that other types of infill panels can be employed.

Figure 4:
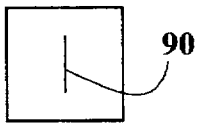
FIG. 4 is a top view of a membrane of the weep valve of the present invention illustrating a first alternate pattern of slits.
Figure 5:
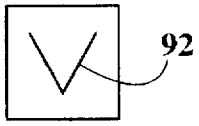
FIG. 5 is a top view of a membrane of the weep valve of the present invention illustrating a second alternate pattern of slits.
Figure 6:
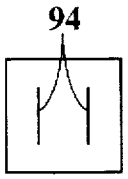
FIG. 6 is a top view of a membrane of the weep valve of the present invention illustrating a third alternate pattern of slits.
Figure 7:
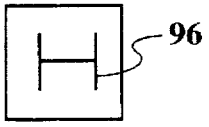
FIG. 7 is a top view of a membrane of the weep valve of the present invention illustrating a fourth alternate pattern of slits.
Figure 8:
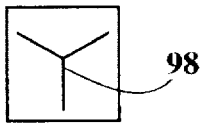
FIG. 8 is a top view of a membrane of the weep valve of the present invention illustrating a fifth alternate pattern of slits.
Figure 9:
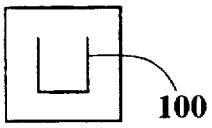
FIG. 9 is a top view of a membrane of the weep valve of the present invention illustrating a sixth alternate pattern of slits.
Figure 10:
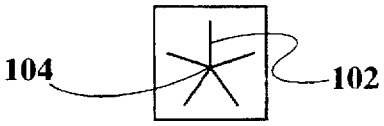
FIG. 10 is a top view of a membrane of the weep valve of the present invention illustrating a seventh alternate pattern of slits.

In addition, while the weep valve 60 of the disclosed embodiment comprises a slit 66 in the shape of an "X," it will be appreciated that slits of other configurations can be used, including, without limitation, a single slit 90, as shown in FIG. 4; a pair of slits 92 which intersect in configurations other than an "X" (a "V," for example, as shown in FIG. 5); two or more slits 94 which do not intersect, as shown in FIG. 6; or various configurations of more than a pair of slits, including but not limited to slits 96 in the form of an "H" (FIG. 7); slits 98 in the form of a "Y" (FIG. 8), slits 100 in the shape of a "U" (FIG. 9); or a plurality of slits 102 radiating outward from a common vortex 104 (such as "*"), as is shown in FIG. 10. In addition, the preferred slit configuration may depend on the orientation of the weep hole 26. For example, a "V" or "U" shaped slit may be most effective when the weep valve 60 is in a vertical orientation.

Also, while the weep valve 60 of the foregoing embodiment has a square configuration, it will be appreciated that any shape may be employed so long as the weep valve is sufficiently large to overlie the weep hole 26.

Finally, it will be understood that the preferred embodiment has been disclosed by way of example, and that other modifications may occur to those skilled in the art without departing from the scope and spirit of the appended claims.

What is claimed is:

1. In a building frame member comprising a weep hole for draining water away from an interior cavity, the improvement comprising:

a membrane adhered to said frame member in overlying relation to said weep hole; and at least one slit formed through said membrane in register with said weep hole;

whereby water which exits said weep hole will seep through said at least one slit; and whereby said at least one slit seals sufficiently tightly against airflow so that water infiltration back through said weep hole into said interior cavity is virtually eliminated.

2. The improvement of claim 1, wherein said membrane is comprised of an elastomeric material.

3. The improvement of claim 2, wherein said elastomeric material has a hardness of from about 60 to about 70 on the Shore A hardness scale.

4. The improvement of claim 1, wherein said at least one slit formed through said membrane comprises a pair of slits which intersect generally in the shape of an "X."

5. The improvement of claim 1, wherein said at least one slit formed through said membrane comprises a pair of slits which intersect generally in the shape of a "V."

6. The improvement of claim 1, wherein said at least one slit formed through said membrane comprises three slits which intersect generally in the shape of an "Y."

7. The improvement of claim 1, wherein said at least one slit formed through said membrane comprises three slits which intersect generally in the shape of an "H."

8. The improvement of claim 1, wherein said at least one slit formed through said membrane comprises two or more slits which do not intersect.

9. The improvement of claim 1, wherein said at least one slit formed through said membrane comprises a plurality of slits radiating outward from a common vortex.

10. The improvement of claim 1, further comprising a spacer interposed between said membrane and said building frame member, said spacer comprising a means for permitting water to pass therethrough to said at least one slit of said membrane.

11. The improvement of claim 10, wherein said means for permitting water to pass therethrough to said at least one slit of said membrane comprises a hole formed through said spacer and overlying said at least one slit.

12. The improvement of claim 10, wherein said means for permitting water to pass therethrough to said at least one slit of said membrane comprises at least one slit formed through said spacer in register with said at least one slit of said membrane.

13. The improvement of claim 1, wherein said membrane is adhered to said building frame member by means of a double-sided tape.

14. The improvement of claim 1, wherein said membrane comprises a periphery an inner face, and a marginal portion adjacent said periphery of said membrane, and wherein said membrane is adhered to said building frame member by means of a conventional adhesive applied around said marginal portion of said inner face of said membrane.

15. The improvement of claim 10, wherein said membrane is adhered to said building frame member by means of said spacer comprising a double-sided tape.

* * * * *